United States Patent [19]

Dunlap

[11] 3,987,700

[45] Oct. 26, 1976

[54] ADJUSTABLE BOW GUIDE

[76] Inventor: Daniel Dunlap, 32 W. 69th St., Apt. 3-A, New York, N.Y. 10023

[22] Filed: Dec. 4, 1975

[21] Appl. No.: 637,584

[52] U.S. Cl. ..... 84/283
[51] Int. Cl.[2] ..... G10D 1/02
[58] Field of Search ..... 84/283

[56] References Cited

UNITED STATES PATENTS

| | | | |
|---|---|---|---|
| 766,549 | 8/1904 | Strauss et al. | 84/283 |
| 3,169,438 | 2/1965 | Belcher | 84/283 |
| 3,730,964 | 5/1973 | Kaplan | 84/283 |

FOREIGN PATENTS OR APPLICATIONS

| | | | |
|---|---|---|---|
| 28,771 | 1/1933 | Netherlands | 84/283 |

*Primary Examiner*—Stephen J. Tomsky
*Attorney, Agent, or Firm*—Smith, Harding, Earley & Follmer

[57] ABSTRACT

A bow guide comprises a pair of stop members which are secured to a fingerboard gripping means by telescoping elements which provide for adjustment of the stop means relative to the fingerboard and relative to each other.

12 Claims, 5 Drawing Figures

ADJUSTABLE BOW GUIDE

BACKGROUND OF THE INVENTION

This invention relates to bow guides for musical instruments of the violin family.

It is very difficult for beginners learning to play the violin and other instruments in the violin family to keep the bow perpendicular to the strings and at the proper distance from the bridge of the instrument. Very often, the beginner inadvertently moves the bow longitudinally, (that is in the direction of the strings of the instrument) either toward the bridge of the instrument, or more likely toward the scroll, causing the instrument to emit undesirable sound. Failure to maintain the bow perpendicular to the string also results in a failure to maintain consistency in the tones produced. Even advanced players have trouble maintaining the bow in a perpendicular relationship to the strings.

These problems have been long recognized by violin instructors, and a number of different training aids have been developed. For example, a training device comprising a simulated violin body having a transverse groove for guiding an articifical bow is described in U.S. Pat. No. 88,423, dated Mar. 30, 1869. A similar instruction device having rotatable groove-providing means and a perpendicularly indicator is described in U.S. Pat. No. 2,239,579, dated Apr. 22, 1941.

The prior art also contains a number of patents describing "bow guides" which are violin attachments usable during actual playing of the instrument. In general, the purpose of a bow guide is to limit longitudinal bow movement, and, in some cases, to insure perpendicularity of the bow with respect to the strings. U.S. Pat. No. 316,157, dated Apr. 21, 1885 describes a typical bow guide which consists of a stop member adapted to be clamped onto a violin fingerboard by a screw-type clamping means. This bow guide prevents the bow from being moved longitudinally over the fingerboard, but does not prevent movement of the bow toward the bridge. Similar bow guides are described in the following U.S. Pat. Nos. 713,171, dated Nov. 11, 1902; 1,228,949, dated June 5, 1917; 1,192,030, dated July 25; 1916; 1,788,700, dated Jan. 13, 1971; 3,107,568, dated Oct. 22, 1963; and 3,169,438, dated Feb. 16, 1965. Some of the device described in these patents provide for a minor longitudinal adjustment of the stop, but none of them limits the movement of the bow toward the bridge, and none of them is of appreciable help in controlling perpendicularity.

Another class of bow guide is exemplified by U.S. Pat. No. 196,325, dated Oct. 23, 1877, wherein a pair of slotted upright members clamped to the body of the violin insure that the bow is maintained in a perpendicular relationship to the strings, and within a narrow longitudinal range of positions. Similar devices are described in the following U.S. Pat. Nos. 243,763, dated July 5, 1881, 1,325,251, dated Dec. 16, 1919; 1,508,830, dated Sept. 16, 1924; 1,603,371, dated Oct. 19, 1926; 1,623,633, dated Apr. 5, 1927; 2,782,670, dated Feb. 26, 1957; 3,306,150, dated Feb. 28, 1967; and 1,562,062, dated Nov. 17, 1925. Another such device is described in German Pat. Nos. 519,204, dated Jan. 26, 1929. The bow guides in these patents limit movement toward the bridge as well as toward the scroll. Again, adjustability, to the extent that it exists in these devices, is very limited.

U.S. Pat. No. 3,730,964, dated May 1, 1973 describes a bow position sensor in which an element secured to the end of the fingerboard and extending longitudinally underneath the strings is provided with a series of slots for receiving a pair of sensors which acts a bow guides, and limit movement in both longitudinal directions. The slots limit the sensors to a limited number of discrete positions so that there is no continuous adjustability. The position sensors are not capable of insuring perpendicularity between the bow and the strings.

Nevertheless Pat. No. 28,771, dated Jan. 16, 1933 describes a bow guide with adjustable stops formed of wire. The stops are independently adjustable in the longitudinal direction, and are so configured as to aid substantially in maintaining a perpendicular relationship between the bow and the strings. However, the wire stops are secured to the fingerboard of the instrument by a clamping device which clamps both ends of each wire stop. The clamping device must be loosened on the fingerboard before the wire stops can be adjusted. The clamp extends over the fingerboard and over the strings, making it impossible to finger the strings near the end of the fingerboard to produce very high pitched notes. The wire stops also pose an obstacle to the fingers of the hand holding the bow, and therefore interfere with the full use of the bow hair. This patent is believed to represent the closest prior art.

None of the prior art devices provides for rapid adjustment of the longitudinal range within which the bow can contact the strings and the longitudinal position of said range. Furthermore, none of the bow guides in the prior art provides for such adjustments while providing at the same time for control of perpendicularity between the bow and the strings.

The principal object of this invention is to provide an improved bow guide wherein continuous adjustments (i.e., adjustments not limited to discrete positions) may be rapidly made for controlling the width of the longitudinal range within which the bow can contact the strings, and the longitudinal position of that range, thereby making it possible for the student to isolate and practice any desired range of timbres possible in the distance between the bridge and the fingerboard of the instrument.

Another object of the invention is to provide a rapidly adjustable bow guide which imposes a minimum of interference with the full use of the bow hair and which insures against the possibility of snagging the bow hair on parts of the bow guide.

It is also an object of the invention to provide a rapidly adjustable fingerboard-mounted bow guide which controls perpendicularity between the bow and the strings, and the settings of which are accurately reproducible.

A further object of the invention is to enable the student musician to maintan bow position and perpendicularity artificially so that he can more easily concentrate on bow pressure and speed.

A still further object of the invention is to provide a bow guide in which the range and position of the range can be adjusted and wherein the position of the range can be rapidly adjusted without changing the longitudinal extent of the range.

Other objects will be apparent from the following Detailed Description when read in conjunction with the drawings.

Stated briefly, the bow guide in accordance with the invention comprises first and second stop members adapted to extend laterally over at least part of the strings of the instrument at longitudinally spaced locations to constrain the bow to movements substantially perpendicular to the strings and within a relatively narrow longitudinal range between the bridge and the end of the fingerboard, and means for supporting the first and second stop members from the fingerboard, the supporting means comprising means for firmly gripping the fingerboard, and means frictionally securing the stop members to the gripping means and permitting longitudinal adjustment of the stop members relative to the fingerboard and relative to each other while the gripping means firmly grips the fingerboard.

DETAILED DESCRIPTION

Figure 1:
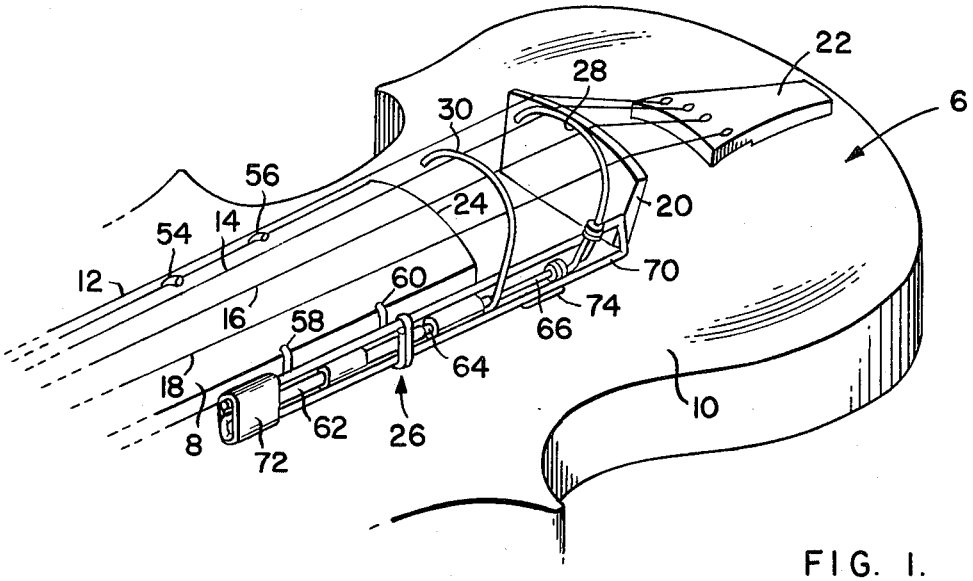
FIG. 1 is a partial perspective view showing a violin to which is attached a first embodiment of an adjustable bow guide in accordance with the invention.

FIG. 1 shows a conventional violin 6 in which four strings are stretched longitudinally along a fingerboard 8 which is raised, i.e., spaced from the top 10 of the violin. The strings comprise a first or E string 12, a second or A string 14, a third or D string 16, and a fourth or G string 18. The strings extend over a bridge 20, and are secured to tailpiece 22.

Figure 2:
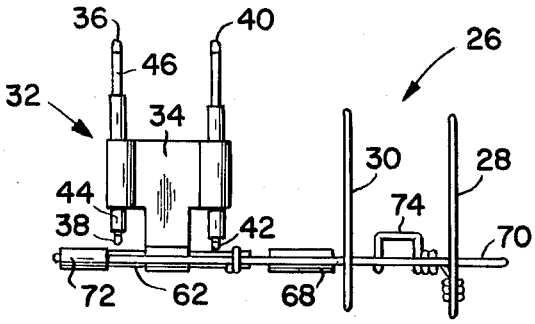
FIG. 2 is a top plan view of the bow guide shown in FIG. 1.

The strings of the violin are normally contacted by the bow at some location between the bridge and end 24 of the fingerboard. Within this broad range an infinite variety of tone colors is available, depending on the position of the bow. In order to confine the bow to a relatively narrow longitudinal range within this broad range there is provided a bow guide generally designated 26, as shown in FIGS. 1 and 2.

The bow guide comprises a pair of stop members 28 and 30, which take the form of inverted U-shaped arms, preferably of stiff metal wire shaped to conform generally to the curvature of the bridge so that they can be spaced by a small distance from the strings over which they extend. The stop members extend laterally (transverse to the longitudinal direction) over at least some of the strings of the instrument at longitudinally spaced locations between bridge 20 and end 24 of the fingerboard. By reason of their lateral extent, they constrain the bow to movement which is substantially perpendicular to the strings. That is, the stops prevent the bow from being rotated out of perpendicularity with the strings to an extent such as to affect the tone of the instrument noticeably.

Stop members 30 and 28 preferably extend only over the second, third and fourth strings of the violin, and downwardly toward the top 10 of the instrument, between the first and second strings 12 and 14 and through the plane in which first and second strings lie. The ends of the stop members are below the strings. Thus, while each of the stop members is supported at only one end in order to facilitate rapid adjustment, the free ends of the stop members cannot snag the bow hair. Since the stop members do not extend over the first string, interference with full use of the bow hair is reduced. The stop members can be modified, if desired, so that they extend downwardly between other pairs of strings. However, from the standpoint of obtaining maximum use of the bow hair, and at the same time insuring that bow position and perpendicularity are controlled at all times, the arrangement shown in the drawings is preferred.

Figure 4:
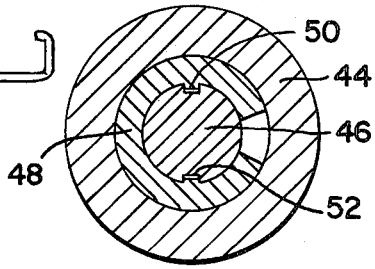
FIG. 4 is a section taken on the plane 4—4 of FIG. 3.
Figure 3:
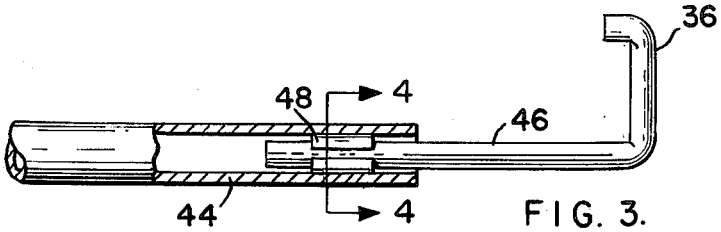
FIG. 3 is a sectional view showing the details of a gripping device for securing the bow guide to the fingerboard of an instrument.

In order that stop members 28 and 30 may be easily and rapidly adjusted in the longitudinal direction, they are supported from fingerboard 8 by a special structure in accordance with the invention which permits the student musician to adjust both the longitudinal positions and the relative longitudinal spacing of the stop members. The supporting means for the stop members comprises a clamp, shown in FIG. 2 and generally designated 32, for firmly gripping the fingerboard. This clamp preferably comprises a frame 34 adapted to be located underneath the fingerboard, between the fingerboard and the top of the instrument, and gripping elements attached to the frame and adapted to grip the longitudinal edges of the fingerboard thereby securing the frame 34 to the fingerboard. These gripping elements can take various forms. Preferably, however the gripping elements are constructed as shown in FIG. 2, which shows a first hook-shaped gripping element 36 and a second hook-shaped gripping element 38. Elements 36 and 38 are relatively moveable toward and away from each other so that they are adapted to grip the opposite longitudinal edges of a violin fingerboard. A second pair of gripping elements 40 and 42, similar to elements 36 and 38 are provided on frame 34 to hold the frame more securely to the fingerboard. Element 38 is secured to a tubular member 44 which is secured to frame 34. Element 36 is provided with an extension 46, which slides into and out of tublar member 44 in order to permit relative adjustment of members 36 and 38. The relationship between the opposing gripping elements 36 and 38 is maintained by frictional means as illustrated in FIGS. 3 and 4, which show a spring metal clip 48 held in fixed relationship to extension 46 by means of projections 50 and 52 which extend inwardly from clip 48 into depressions in extension 46. The clip bears outwardly against the inner surface of tubular member 44 and maintains a frictional engagement between gripping member 36 and 38. A similar structure maintains a frictional engagement between gripping members 40 and 42. The frame 34 can be readily engaged and disengaged from the fingerboard by manipulation of the gripping elements. With the frame underneath the fingerboard, the only parts of the clamp on the fingering surface of the fingerboard are the same ends of the gripping elements shown in FIG. 1 at 54, 56, 58 and 60. These ends do not interfere with fingering.

By mounting the bow guide on the fingerboard in this manner, the muting effect inherent in bridge-mounted bow guides is avoided, yet the fingerboard is not obscured, and there is no interference with fingering near the end of the fingerboard.

The supporting means for the stop members also comprises means for frictionally securing the stop members 28 and 30 to the clamp (i.e., gripping means) and permitting longitudinal adjustment of the stop members relative to the fingerboard and relative to each other. The means for frictionally securing stop members 28 and 30 to the gripping means preferably comprises three telescoping elements 62, 64 and 66 as shown in FIG. 1. Element 62 is tubular and is secured to the frame 34 of clamp 32, and is preferably the largest of the three telescoping elements. Element 64 is also tubular and is intermediate in size, and slidable into element 62. Stop 30 is secured to element 64 by clip 68, and stop 30 being thus secured moves in the longitudinal direction with element 64 as it slides into and out of element 62. Telescoping element 66 is the smallest of the three elements, and is similarly arranged to slide longitudinally into and out of element 64. Stop 28 is secured to element 66, and both stop 66 and element 68 may be formed from a single piece of metal wire, bent to the appropriate shape. Thee telescoping elements are preferably provided with friction clips, similar to clip 48 shown in FIGS. 3 and 4, to prevent the stops from moving longitudinally unless they are pushed manually. By manipulating the two stop members, the musician playing the instrument can rapidly adjust both the width of the longitudinal range within which the bow can contact the strings, and the longitudinal position of said range. These adjustments can be made very rapidly by simply sliding the stops to the desired positions, and they can be made without loosening the grip of the clamp on the fingerboard. While both the range (the distance between the stops) and the positions of the range are adjustable, the position of the range can be rapidly adjusted by manipulation of element 30. Element 28 moves with element 30 so that the size of the range is not changed during the adjustment.

The telescoping members are provided only on one side of the fingerboard, and therefore it is necessary to insure that the stop members are maintained with at least a minimum spacing from the strings of the instrument. To this end, a framework 70 comprising a U-shaped wire is rigidly attached to the gripping means through element 62 to which the framework is attached by clip 72. The frame 70 extends alongside the telescoping members, the telescoping members 62, 64 and 66 being preferably located between the two lengthwise elements of frame 70. Attached to the wire from which stop 28 and element 66 is formed is an auxiliary wire means 74 positioned so that it rotates about a longitudinal axis with stop 28, and engages the frame 70 when stop 28 is in its proper position just above the strings. Stop 30 extends outwardly around telescoping member 66 and its movement toward the strings is limited by engagement with member 66.

Figure 5:
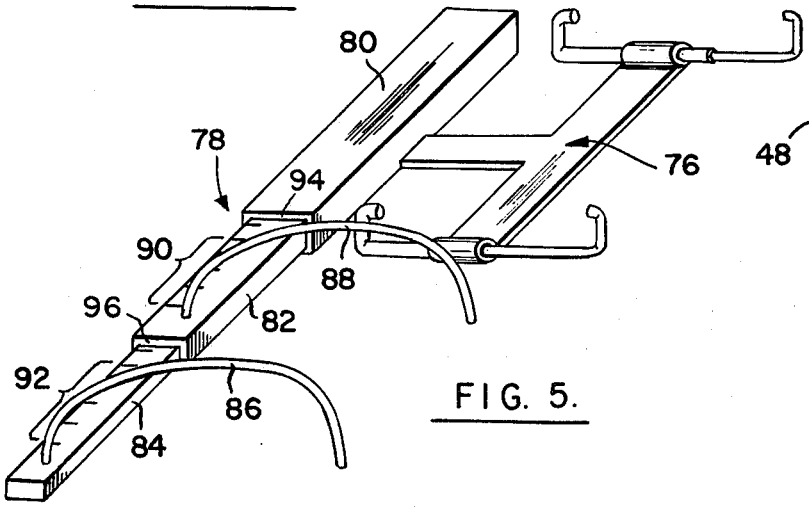
FIG. 5 is a perspective view of a bow guide in accordance with the second embodiment of the invention.

Rotation of the stops can be limited in another manner as illustrated by the embodiment in FIG. 5. In FIG. 5, a clamp 76 similar to clamp 32 is adapted to secure a telescoping assembly 78 to the fingerboard of an instrument. The telescoping assembly comprises a first element 80 secured to the clamp, a second element 82 slidable into element 80 and a third element 84 slidable into element 82. These elements fit together closely so that a frictional engagement is achieved preventing the elements from sliding except when manipulated. Elements 80, 82 and 84 are preferably extruded from a plastic such as polypropylene, and are non-circular in cross-section, preferably rectangular, in order to prevent relative rotation. A first stop 86 is secured to element 84 near its end farthest from the clamp, and a second stop 88 is secured to element 52 near its end farthest from the clamp. Auxiliary friction providing means similar to that shown in FIGS. 3 and 4 can be used if desired.

The bow guide of FIG. 5 is provided with index markings 90 and 92 respectively on elements 82 and 84. These markigs can be read against the ends 94 and 96 of elements 80 and 82 enabling the student to reproduce any desired setting of the stops.

Various modifications can be made to the invention described including but not necessarily limited to those mentioned below. The clamp which secures the telescoping assembly to the fingerboard can take various alternative forms. For example, a spring-loaded clamp or a screw clamp could be used. While it is preferred that the largest of the telescoping elements be the one secured to the clamp, the telescoping elements can be arranged in order of size opposite to that shown. Various alternative to the specific arrangement of index markings in FIG. 5 are possible, and markings can be provided on the structure of FIG. 1 if desired. Instead of preventing rotation of the stops by the auxiliary means 74 of FIG. 1 or by the non-circular telescoping elements of FIG. 5, pin-and-slot means or other devices for preventing rotation can be used.

This invention is, of course, applicable to other instruments of the violin family such as violas and cellos.

I claim:

1. A bow guide for a musical instrument of the violin family having strings stretched longitudinally along a raised fingerboard and over a bridge spaced longitudinally from the end of the fingerboard comprisng:

first and second stop members adapted to extend laterally over at least some of the strings of the instrument at longitudinally spaced locations to constrain the bow to movement substantially perpendicular to the strings and within a relatively narrow longitudinal range between the bridge and the end of the fingerboard; and means for supporting said firt and second stop members from said fingerboard, said supporting means comprising means for firmly gripping said fingerboard, and means frictionally securing said stop members to said gripping means and permitting longitudinal adjustment of said stop members relative to the fingerboard while said gripping means firmly grips said fingerboard;

whereby the musician playing the instrument can rapidly adjust the position of the longitudinal range within which the bow can contact the strings.

2. A bow guide for a musical instrument of the violin family having strings stretched longitudinally along a raised fingerboard and over a bridge spaced longitudinally from the end of the fingerboard comprising:

first and second stop members adapted to extend laterally over at least some of the strings of the instrument at longitudinally spaced locations to constrain the bow to movement substantially perpendicular to the strings and within a relatively narrow longitudinal range between the bridge and the end of the fingerboard; and means for supporting said first and second stop members from said fingerboard, said supporting means comprising means for firmly gripping said fingerboard, and means frictionally securing said stop members to said gripping means and permitting longitudinal adjustment of said stop members relative to the fingerboard and relative to each other while said gripping means firmly grips said fingerboard;

whereby the musician playing the instrument can rapidly adjust both the width of the longitudinal range within which the bow can contact the strings, and the longitudinal position of said range.

3. A bow guide according to claim 2 in which said means frictionally securing said stop members to said gripping means comprises three telescoping elements, a first of said three elements being secured to said gripping means, a second of said three elements being secured to the one of said stop members nearest the gripping means, and a third of said three elements being secured to the other top member.

4. A bow guide according to claim 3 including means for limiting rotation of said stop members about a longitudinal axis toward the strings of the instrument, whereby the stop members are maintained with at least a minimum spacing from said strings.

5. A bow guide according to claim 3 in which said telescoping elements are non-circular in cross-section.

6. A bow guide according to claim 3 in which said telescoping elements are rectangular in cross-section.

7. A bow guide according to claim 3 in which the two smallest one of said three telescoping elements carry index markings.

8. A bow guide according to claim 2 in which said gripping means comprises a frame adapted to be located underneath the fingerboard of said instrument, and gripping elements attached to said frame, said gripping elements being relatively movable toward and away from each other and adapted to grip the longitudinal edges of said fingerboard, thereby securing the said frame to the fingerboard.

9. A bow guide according to claim 2 in which both stop members are shaped so that, when the bow guide is in place on said instrument, said stop members extend downwardly toward the top of said instrument between the first and second strings of the instrument and through the plane in which the first and second strings lie.

10. A bow guide according to claim 2 in which each stop member is shaped so that, when the bow guide is in place on said instrument, each of said stop members extends downwardly toward the top of the instrument between a pair of adjacent strings and through the plane in which said adjacent strings lie.

11. In a musical instrument of the violin family having strings stretched longitudinally along a raised fingerboard and over a bridge spaced longitudinally from the end of said fingerboard, a bow guide comprising:

first and second stop members adapted to extend laterally over at least some of the strings of the instrument at longitudinally spaced locations to constrain the bow to movement substantially perpendicular to the strings and within a relatively narrow longitudinal range between the bridge and the end of the fingerboard; and means for supporting said first and second stop members from said fingerboard, said support means comprising means for firmly gripping said fingerboard, and means frictionally securing said stop members to said gripping means and permitting longitudinal adjustment of said stop members relative to the fingerboard while said gripping means firmly grips said fingerboard;

each of said stop members extending downwardly toward the top of the instrument between a pair of adjacent strings and through the plane in which said strings lie.

12. A bow guide according to claim 11 in which both of said stop members extend downwardly toward the top of the instrument between the first and second strings of the instrument and through the plane in which said first and second strings lie.

* * * * *